US008689413B2

(12) United States Patent
Ramaswami

(10) Patent No.: US 8,689,413 B2
(45) Date of Patent: Apr. 8, 2014

(54) HIGH TEAR STRENGTH FLAME RESISTANT COTTON FABRIC

(76) Inventor: Manikam Ramaswami, Chennai (IN)

( * ) Notice: Subject to any disclaimer, the term of this patent is extended or adjusted under 35 U.S.C. 154(b) by 0 days.

(21) Appl. No.: 13/537,484

(22) Filed: Jun. 29, 2012

(65) Prior Publication Data

US 2012/0282835 A1 Nov. 8, 2012

(51) Int. Cl.
*D06C 9/00* (2006.01)
*D02J 3/16* (2006.01)
*D03D 15/00* (2006.01)

(52) U.S. Cl.
USPC ..... 28/165; 28/166; 28/167; 28/169; 28/239

(58) Field of Classification Search
USPC ..... 28/165, 166, 167, 169, 239, 217, 219, 28/220, 173, 174; 57/75, 309; 8/115.51, 8/115.6, 116.1, 127.1, 149.2; 427/223
See application file for complete search history.

(56) References Cited

U.S. PATENT DOCUMENTS

| | | | | | |
|---|---|---|---|---|---|
| 3,022,564 | A | * | 2/1962 | Price | 28/239 |
| 3,224,182 | A | * | 12/1965 | Sloan et al. | 57/295 |
| 3,367,003 | A | * | 2/1968 | Scott | 26/3 |
| 3,874,046 | A | * | 4/1975 | Aschwanden et al. | 28/239 |
| 4,371,485 | A | * | 2/1983 | Mathes et al. | 264/46.1 |
| 4,812,144 | A | | 3/1989 | Hansen | |
| 4,858,288 | A | * | 8/1989 | Hodgin et al. | 28/178 |
| 5,263,311 | A | * | 11/1993 | Feil et al. | 57/333 |
| 5,482,763 | A | | 1/1996 | Shaffer | |
| 6,032,340 | A | * | 3/2000 | Greif et al. | 28/166 |
| 7,393,800 | B2 | | 7/2008 | Corner | |
| 7,589,036 | B2 | | 9/2009 | Corner et al. | |
| 2003/0165656 | A1 | * | 9/2003 | Miller et al. | 428/92 |
| 2004/0137818 | A1 | * | 7/2004 | Kimbrell et al. | 442/211 |
| 2006/0264136 | A1 | | 11/2006 | Chiantese | |
| 2009/0221204 | A1 | | 9/2009 | De Saedeleir | |
| 2010/0210162 | A1 | * | 8/2010 | Li et al. | 442/143 |
| 2010/0330351 | A1 | * | 12/2010 | Crnoja-Cosic et al. | 428/219 |
| 2011/0092119 | A1 | * | 4/2011 | Cliver et al. | 442/143 |
| 2012/0270456 | A1 | * | 10/2012 | Gstettner et al. | 442/302 |

FOREIGN PATENT DOCUMENTS

| | | |
|---|---|---|
| CN | 101092776 | 6/2006 |
| CN | 101377027 | 9/2008 |

OTHER PUBLICATIONS

International Search Report for PCT/IN2010/00863, dated May 19, 2011.

* cited by examiner

*Primary Examiner* — Amy Vanatta
(74) *Attorney, Agent, or Firm* — Michael J. Feigin, Esq.; Feigin & Associates, LLC

(57) ABSTRACT

A flame resistant fabric with better tear strength and specifically a flame resistant fabric with tear strength flame resistant 100% cotton yarn are provided. The 100% cotton yarn is produced using a combination of compact spinning technology and gassing and/or singeing process performed in tandem, the yarn is weaved into fabric by pre-established process and the fabric is flame retardant finished by using chemicals and lubricants by pre-established process to form the flame resistant fabric with better tear strength. Also, a method of manufacturing the flame resistant cotton fabric that has a better tear strength after fire resistant treatments provided. Advantageously, the flame resistant fabric is affordable, light weight and has better tensile and tear strength.

8 Claims, No Drawings

HIGH TEAR STRENGTH FLAME RESISTANT COTTON FABRIC

FIELD OF INVENTION

The present invention relates to flame resistant fabric and specifically relates to better tear strength flame resistant 100% cotton fabric. Also, the present invention relates to a method of manufacturing the flame resistant cotton fabric that has a better tear strength after fire resistant treatment. Advantageously, the flame resistant fabric of the present invention is affordable, light weight and has better tensile and tear strength.

DESCRIPTION OF PRIOR ART

Electricity companies and other similar industries need a fabric that can protect the wearer from fire, heat and electric arc and at the same time it should be light enough to make it comfortable to wear and breathable to make it comfortable. The fabric should also be affordable and shall posse's good tensile and tear strength. Currently, flame resistant fabrics are made of heavy cotton fabrics; blends with aramid; mod acrylic or other chemical fibers. The presently used fabrics are very uncomfortable and at times workers have been found not wearing the garment. Many options are available but most are either uncomfortable (heavy and/or poor perspiration) or very expensive.

Light cotton fabrics mainly suffer from poor tear strength after repeated washes and the same needs to be overcome. 100% heavy cotton fabrics when treated with flame resistant chemicals tend to become weaker both in tensile and tear strength than the requirements of the users. The tear strength of fabrics made out of normal yarn deteriorates when washed or during the processing as hairs start appearing; this reduces the tear strength after flame resistant treatment. Though lubricants are used during the flame retardant finish processing to control drop in tear strength, such lubricants get washed away during repeated washes and give room for lowering the tear strength.

U.S. Pat. No. 7,589,036 disclosed a flame resistant fabrics having increased strength that includes a plurality of flame resistant body yarns that form a body of the fabric, and a plurality of relatively tough yarns provided in discrete positions within the fabric body.

U.S. Pat. No. 7,393,800 disclosed relates to flame resistant fabrics that have both increased strength and increased resistance to abrasion.

U.S. Pat. No. 5,482,763 provides a light weight tear resistant fabric composed of a background fabric and meta-aramid reinforcing continuous filament yarn of comparable denier.

WO8900217 relates to a flame-resistant fabrics made of blends of cotton and nylon in which the nylon content is in excess of 40%, having improved durability of flame resistance by means of a two-step application process.

GB 191315867 provides an improved process for singeing yarn and fabrics and apparatus therefor.

WO 2004076730 disclosed a fabric with high fire-resistant properties, consisting of various types of yarns consisting of meta-aramidic or para-aramidic fibers and fibers based on pre-oxidized carbon or novoloid, respectively, which are highly fire-resistant materials. Thus it can be seen that needs exist to provide a method and process of manufacturing 100% cotton flame resistant fabric that has a better tear strength after fire resistant treatment by reducing the hairiness of the fabric. Moreover, it is essential that all types of hair has to be removed fully and also the process of yarn making should ensure that substantial hairs do not appear during the processing or subsequent washing. In these respects, the present invention substantially departs from the conventional concepts and designs of the prior art and in so doing it overcome other problems encountered in conventional products and services.

OBJECTS OF THE INVENTION

One or more of the problems of the conventional prior art may be overcome by various embodiments of the system and method of the present invention.

Accordingly, it is the primary object of the present invention to provide for flame resistant cotton fabric that has a better tear strength after fire resistant treatment.

It is another object of the present invention to provide for 100% cotton flame resistant fabric besides other fibers blended with cotton.

It is another object of the present invention to provide for flame resistant cotton fabric which is affordable, light weight and which has better tensile and tear strength.

It is another object of the present invention, wherein the flame resistant cotton fabric is light weight, cheaper and provides more comfort to the wearer.

It is another object of the present invention to provide to a method of manufacturing the flame resistant cotton fabric.

It is another object of the present invention, wherein the inherent loss of strength in fabric during the process of flame retardant finish is compensated by the enhanced tear strength of the fabric produced using the yarn manufactured as per the present invention.

SUMMARY OF THE INVENTION

Thus according to the basic aspect of the present invention there is provided a fabric with better tear strength and flame resistant properties comprising:

100% cotton yarn which is produced using a combination of compact spinning technology and gassing and/or singeing process;

weaving the yarn into fabric by pre-established process; and flame retardant finishing of the fabric using chemicals and lubricants by pre-established process, wherein the compact spinning and gassing and/or singeing processes are performed in tandem, wherein the compact spinning process removes all but short hair, wherein the gassing and/or singeing process removes all hair including short, medium and long, and wherein the fibers in the yarn due to compact spinning are aligned and embedded to provide enhanced tear strength by preventing the surface fibers getting stretched and/or stressed and breaking during processing and/or subsequent washing which produces hairiness.

In accordance with another aspect of the present invention there is provided a fabric with better tear strength and flame resistant properties comprising:

blended cotton yarn which is produced using a combination of compact spinning technology and gassing and/or singeing process;

weaving the yarn into fabric by pre-established process; and flame retardant finishing of the fabric using chemicals and lubricants by pre-established process, wherein the compact spinning and gassing and/or singeing processes are performed in tandem, wherein the compact spinning process removes all but short hair, wherein the gassing and/or singeing process removes all hair including short, medium and long, and wherein the fibers in the yarn due to compact spinning are aligned and embedded to provide enhanced tear strength by preventing the surface fibers getting stretched and/or stressed and breaking during processing and/or subsequent washing which produces hairiness.

It is another aspect of the present invention, wherein the aligning and embedding of the yarn reduces the loss of strength during usage and repeated washing of the garment.

It is another aspect of the present invention, wherein the fabric retains its flame resistant properties for at least 50 wash cycles.

According to another aspect of the present invention there is provided a fabric with better tear strength and flame resistant properties, wherein the flame retardant finishing process in a pre-established manner which causes inherent loss of strength in fabric is compensated by the enhanced tear strength of the fabric.

According to another aspect of the present invention there is provided a method of manufacturing fabric with better tear strength and flame resistant properties comprising: using 100% cotton fibers;

compact spinning the fibers in to yarn;

removing the short fibers remaining after the compact spinning process by gassing and/or singeing;

weaving the yarn into fabric by pre-established process; and providing the fire retardant treatment using chemicals and lubricants by pre-established process, wherein the compact spinning process and gassing and/or singeing are performed in tandem, wherein the compact spinning process removes all but short hair, wherein the gassing and/or singeing process removes all hair including short, medium and long, and wherein the fibers in the yarn due to compact spinning are aligned and embedded to provide enhanced tear strength by preventing the surface fibers getting stretched and/or stressed and breaking during processing and/or subsequent washing which produces hairiness.

In another aspect of the present invention there is provided a method of manufacturing fabric with better tear strength and flame resistant properties comprising:

using blended cotton fibers;

compact spinning the fibers in to yarn;

removing the short fibers remaining after the compact spinning process by gassing and/or singeing;

weaving the yarn into fabric by pre-established process; and providing the fire retardant treatment using chemicals and lubricants by pre-established process, wherein the compact spinning process and gassing and/or singeing are performed in tandem, wherein the compact spinning process removes all but short hair, wherein the gassing and/or singeing process removes all hair including short, medium and long, and wherein the fibers in the yarn due to compact spinning are aligned and embedded to provide enhanced tear strength by preventing the surface fibers getting stretched and/or stressed and breaking during processing and/or subsequent washing which produces hairiness.

It is another aspect of the present invention, wherein the aligning and embedding of the yarn reduces the loss of strength during usage and repeated washing of the garment.

It is another aspect of the present invention, wherein the fabric retains its flame resistant properties for at least 50 wash cycles.

It is another aspect of the present invention, wherein the flame retardant finishing process in a pre-established manner which causes inherent loss of strength in fabric is compensated by the enhanced tear strength of the fabric.

It is another aspect of the present invention, wherein the above method is used to produce light weight fabrics with better strength by compensating the inherent loss of strength happening during the flame retardant treatment process.

DETAILED DESCRIPTION OF THE INVENTION

The present invention as discussed hereinbefore relates to a 100% cotton flame resistant fabric that has a better tear strength after fire resistant treatment. In another aspect, the present invention provides a method of manufacturing the flame resistant cotton fabric.

The yarn is produced using "compact spinning" technology, in tandem with singeing/gassing, which drastically reduces the hairiness on the surface of the yarn. The fibers are aligned within the yarn to prevent the surface fibers from getting stretched/stressed to prevent them from breaking during processing and subsequent washing to produce hairiness. Followed by this is the removal of all long, medium and short hair.

In accordance with another aspect of the present invention, the hairiness of the fabrics is reduced in the following manner:

1. Compact spinning—This process removes all but short hair but ensures that substantial additional hairs do not appear during the process or washing subsequently by aligning the fibers parallel without surface stresses which cause the surface fibers to break and produce hairs.
2. Gassing/Singeing—This process removes all hair including short, medium and long but does not ensure that they do not appear during processing or subsequent washing.

Using the above process in tandem would remove all kinds of hair fully and also ensure that substantial additional hairs do not appear during processing or subsequent washing. In addition, the process of compacting and gassing/singeing when performed in tandem ensures that the fibers inside the yarn are properly aligned without surface fibers being stressed and also ensures all types of hairs are almost fully removed which improves tear strength of the treated fabric even after several washes. Moreover, using these two processes in tandem with the objective of aligning the fibers helps the yarn from deteriorating with washing and gassing/singeing it to remove even the short hairs gives the best short term and long term effect needed and improves the tear strength and also reduces the loss of tear strength with washing when the lubricant slowly gets washed off.

The yarn thus produced using "compact spinning" technology, in tandem with singeing/gassing, is used for weaving the fabric. As the fibers are well aligned and well embedded and the hairiness is almost removed, the stress on the surface of the fabric is reduced and thus enhances the tear strength of the fabric. The same attribute contributes to reduction in the loss of strength during usage of the garment and during repeated washing of the garment. Compact spinning technology allows aero-dynamic parallelization and condensation of the fibers after the main draft. The spinning triangle is thus reduced to a minimum. This contributes to good embedding of the fibers.

The inherent loss of strength in fabric during the process of flame retardant finish is compensated by the enhanced tear strength of the fabric produced using the yarn manufactured as per the present invention.

Lubricants which are used during the flame retardant finish processing to control drop in tear strength get washed away during repeated washes and give room for lowering the tear strength. The present invention thus overcome the said disadvantage by removing the hairiness of the fabric and thereby enhances the tear strength of the fabric.

Advantageously, the present invention is also suitable for light weight fabric. The yarn produced with compact spinning technology in tandem with singeing/gassing has better strength, which in turn compensates the inherent loss of strength happening during the flame retardant treatment process which makes it suitable for producing light weight fabric. Lighter the fabric, cheaper it is and also more is the comfort level to the wearer. Light weight fabrics produced with yarn manufactured as per conventional method would not have the above advantage of extra fabric strength and therefore will deteriorate further after flame retardant finish and subsequent usage and washes.

I claim:

1. A method of manufacturing fabric with high tear strength and flame resistant properties, said method comprising:

using 100% cotton fibers;

compact spinning the fibers in to yarn;

removing short hairs on the yarn remaining after the compact spinning process by gassing and/or singeing;

weaving the yarn into fabric on a weaving machine; and performing a fire retardant treatment on the fabric using chemicals and lubricants at subsequent wet processing stage, wherein the compact spinning process and the gassing and singeing are performed in tandem, wherein the compact spinning process eliminates all but short hairs of the yarn, wherein the gassing and/or singeing process removes all hair of the yarn including short, medium and long, and wherein the fibers in the yarn due to compact spinning are aligned and embedded to provide enhanced tear strength by preventing the surface fibers getting stretched and/or stressed and breaking during processing and/or subsequent washing which produces hairiness.

2. The method as claimed in claim 1, wherein the fire retardant treatment causes inherent loss of strength in the fabric and is compensated for by the enhanced tear strength of the fabric.

3. The method as claimed in claim 1, wherein the aligning and embedding of the fibers of the yarn reduces loss of strength during usage and repeated washing of a garment made of the fabric.

4. The method as claimed in claim 3, wherein the fabric retains its flame resistant properties for at least 50 wash cycles.

5. A method of manufacturing fabric with high tear strength and flame resistant properties, said method comprising:

using blended cotton fibers;

compact spinning the fibers in to yarn;

removing short hairs on the yarn remaining after the compact spinning process by gassing and/or singeing;

weaving the yarn into fabric on a weaving machine; and performing a fire retardant treatment on the fabric using chemicals and lubricants at subsequent wet processing stage, wherein the compact spinning process and the gassing and singeing are performed in tandem, wherein the compact spinning process eliminates all but short hairs of the yarn, wherein the gassing and/or singeing process removes all hair of the yarn including short, medium and long and wherein the fibers in the yarn due to compact spinning are aligned and embedded to provide enhanced tear strength by preventing the surface fibers getting stretched and/or stressed and breaking during processing and/or subsequent washing which produces hairiness.

6. The method as claimed in claim 5, wherein the fire retardant treatment causes inherent loss of strength in the fabric and is compensated for by the enhanced tear strength of the fabric.

7. The method as claimed in claim 5, wherein the aligning and embedding of the fibers of the yarn reduces loss of strength during usage and repeated washing of a garment made of the fabric.

8. The method as claimed in claim 7, wherein the fabric retains its flame resistant properties for at least 50 wash cycles.

* * * * *